US010737133B2

(12) United States Patent
Bezemer et al.

(10) Patent No.: US 10,737,133 B2
(45) Date of Patent: Aug. 11, 2020

(54) MUSCLE EXERCISING APPARATUS

(71) Applicant: AXIO Training Systems, LLC, Park City, UT (US)

(72) Inventors: Thomas Edward Bezemer, Park City, UT (US); Allen Brian Shimizu, Scottsdale, AZ (US)

(73) Assignee: AXIO Training Systems, LLC, Park City, UT (US)

( * ) Notice: Subject to any disclaimer, the term of this patent is extended or adjusted under 35 U.S.C. 154(b) by 22 days.

(21) Appl. No.: 16/190,331

(22) Filed: Nov. 14, 2018

(65) Prior Publication Data

US 2019/0143167 A1 May 16, 2019

Related U.S. Application Data

(60) Provisional application No. 62/586,200, filed on Nov. 15, 2017.

(51) Int. Cl.

| | |
|---|---|
| ***A63B 21/22*** | (2006.01) |
| ***A63B 23/035*** | (2006.01) |
| ***A63B 21/00*** | (2006.01) |
| ***A63B 21/06*** | (2006.01) |
| ***A63B 71/06*** | (2006.01) |

(52) U.S. Cl.

CPC ..... *A63B 21/222* (2015.10); *A63B 21/0004* (2013.01); *A63B 21/0608* (2013.01); *A63B 21/4035* (2015.10); *A63B 23/03508* (2013.01); *A63B 2071/0625* (2013.01); *A63B 2071/0655* (2013.01); *A63B 2209/02* (2013.01)

(58) Field of Classification Search

CPC ..... A63B 21/222; A63B 21/0608; A63B 21/0004; A63B 21/4035; A63B 23/03508; A63B 2071/0655; A63B 2209/02; A63B 2071/0625; A63B 23/12; A63B 23/1209; A61H 15/00

See application file for complete search history.

(56) References Cited

U.S. PATENT DOCUMENTS 1,333,005 A * 3/1920 Warner ..... A63B 21/0608 482/110
3,332,166 A * 7/1967 Alexander ..... A63H 33/02 446/431
4,356,915 A * 11/1982 Phillips ..... B65D 85/58 206/315.1
4,632,391 A * 12/1986 Orak ..... A63B 21/0608 446/170
4,770,409 A * 9/1988 Wallisch ..... A63B 23/03533 482/128

(Continued)

*Primary Examiner* — Andrew S Lo

(57) ABSTRACT

An exercise apparatus is provided. The exercise apparatus includes a substantially round, hollow element having an exterior surface and an interior cavity, with the round, hollow element having a U-shaped cross-section, the U-shape including two distal ends. The exercise apparatus also includes at least two rims, each rim positioned about a portion of the round, hollow element at each distal end of the U-shape. A spacer member is located between each distal end of the U-shape and between the rims and at least two fasteners extend between both of the at least two rims, the fasteners providing a clamping force to the at least two rims so that the spacer member and both distal ends of the round, hollow element are fixed relative to each other.

16 Claims, 9 Drawing Sheets

(56) References Cited

U.S. PATENT DOCUMENTS

D301,510 S * 6/1989 Orak ..... D21/684
D302,195 S * 7/1989 Orak ..... D21/682
5,334,113 A * 8/1994 Roepke ..... A63B 21/0724 482/106
5,407,405 A * 4/1995 Oren ..... A63B 7/02 482/106
5,674,162 A * 10/1997 Ellingson ..... A63B 21/0608 482/110
5,692,944 A * 12/1997 Pellicone ..... A63B 21/0608 273/109
5,718,654 A * 2/1998 Kennedy ..... A63B 21/154 482/102
6,500,102 B1 * 12/2002 Domenge ..... A63B 15/005 482/110
7,115,078 B1 * 10/2006 Kalember ..... A63B 21/015 482/117
D658,729 S * 5/2012 McLoughney ..... D21/682
8,382,647 B1 * 2/2013 Hodes ..... A63B 21/072 482/108
8,672,815 B1 * 3/2014 Springer ..... A63B 21/0724 482/106
D733,815 S * 7/2015 Gustafson ..... D21/694
D745,097 S * 12/2015 Webb ..... D21/682
9,259,607 B2 2/2016 Kokenis et al.
9,907,990 B2 * 3/2018 Januszek ..... A63B 21/06
10,124,207 B2 * 11/2018 Artioli ..... A63B 21/072
10,434,358 B2 * 10/2019 Chen ..... A63B 23/0355
2003/0103352 A1 * 6/2003 Yu ..... A63B 21/22 362/287
2003/0134727 A1 * 7/2003 Yu ..... A63B 21/0004 482/110
2005/0003931 A1 * 1/2005 Mills ..... A63B 21/0601 482/5
2005/0143232 A1 * 6/2005 Hung ..... A63B 21/05 482/126
2005/0227831 A1 * 10/2005 Mills ..... A63B 21/0605 482/106
2006/0073951 A1 * 4/2006 Walkow ..... A63B 21/0601 482/109
2008/0242508 A1 * 10/2008 Smith ..... A63B 21/0004 482/2
2009/0280967 A1 * 11/2009 Salzwimmer ..... A63B 19/00 482/110
2011/0224054 A1 * 9/2011 Bernstein ..... A63B 21/0004 482/110
2011/0287907 A1 * 11/2011 Morris ..... A63B 21/00069 482/117
2011/0287909 A1 * 11/2011 Morris ..... A63B 21/0004 482/126
2013/0035218 A1 * 2/2013 Wierszewski ..... A63B 21/072 482/106
2013/0184123 A1 * 7/2013 McLoughney .... A63B 21/0004 482/8
2013/0260969 A1 * 10/2013 Huang ..... A63B 21/015 482/122
2013/0316886 A1 * 11/2013 Lynch ..... A63B 26/003 482/146
2016/0051855 A1 * 2/2016 Warren ..... A63B 21/0602 482/93
2017/0120104 A1 * 5/2017 Douglass ..... A63B 21/00069

* cited by examiner

MUSCLE EXERCISING APPARATUS

REFERENCE TO RELATED APPLICATION

Priority is claimed to provisional application Ser. No. 62/586,200 filed Nov. 15, 2017, entitled "Muscle Exercising Apparatus," which is referred to and incorporated herein in its entirety by this reference.

FIELD OF THE INVENTION

The present invention generally relates to exercising devices.

BACKGROUND OF THE INVENTION

The core muscles in the torso help stabilize the spine and pelvis. These muscles are important, yet commonly neglected, as many people lack the time and energy required to go to the gym every day. A weak core can lead to poor posture, lower back pain and overall physical weakness. A solution is needed to allow users to work out these core muscles quickly and efficiently at home or in other locations, whenever convenient.

However, few devices are available to the consumer that are inexpensive, portable, and easy to use. Therefore, there remains a need to overcome one or more of the limitations in the above-described, existing art. The discussion of the background to the invention included herein is included to explain the context of the invention. This is not to be taken as an admission that any of the material referred to was published, known or part of the common general knowledge as at the priority date of the claims.

Figure 1:
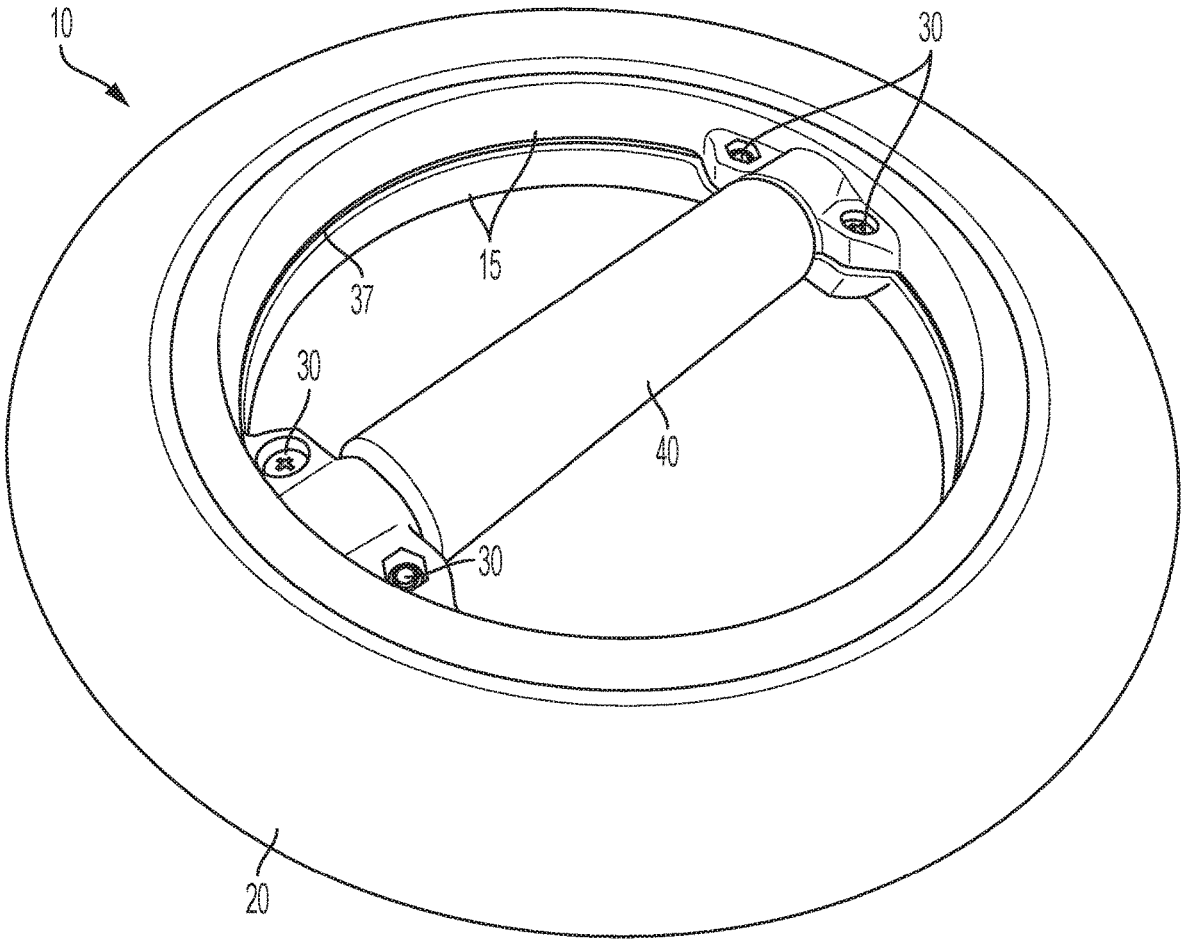
FIG. 1 is a perspective view of one embodiment of the muscle exercising apparatus embodying the principals of the invention.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE PREFERRED EMBODIMENTS

In the following description, for the purposes of explanation, numerous specific details are set forth in order to provide a thorough understanding of the muscle exercise device ("MED") that embodies principals of the present invention. It will be apparent, however, to one skilled in the art that the muscle exercise device may be practiced without some of these specific details. Throughout this description, the embodiments and examples shown should be considered as exemplars, rather than as limitations on the muscle exercise device. That is, the following description provides examples, and the accompanying drawings show various examples for the purposes of illustration. However, these examples should not be construed in a limiting sense as they are merely intended to provide examples of the muscle exercise device rather than to provide an exhaustive list of all possible implementations of the muscle exercise device.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

As illustrated in the Figures, a muscle exercise device (MED) is shown that provides users with a way to effectively exercise their muscles. The "core" or stomach muscles are exercised, as well as the leg, back, shoulder and arm muscles. Additionally, the present invention exercises the cardiorespiratory system and challenges balance (balance in the literal sense and balance in the sense of muscular symmetry/neuromuscular control). The present invention proactively and reactively develops strength and neuromuscular control (coordination). It challenges the user's sensorimotor system to continually identify location of spheres within the channel of the MED, and use strength to generate and modulate force in order to maintain control of the entire system. The present invention has fitness, athletic and rehabilitation applications.

Referring now to FIGS. 1-6, one embodiment of the muscle exercise device (MED) 10 is illustrated. The illustrated embodiment uses two rigid rims 15, with each rim 15 positioned about a portion of a substantially round, hollow element, or raceway 20. In a preferred embodiment, the rims 15 are substantially identical. Located between the two rims 15 is a hoop-shaped spacer member, or inner raceway 25. Fasteners 30 couple the two rims 15 together, and also position and trap the spacer member 25, as shown in cross-section in FIGS. 3-4

Figure 3:
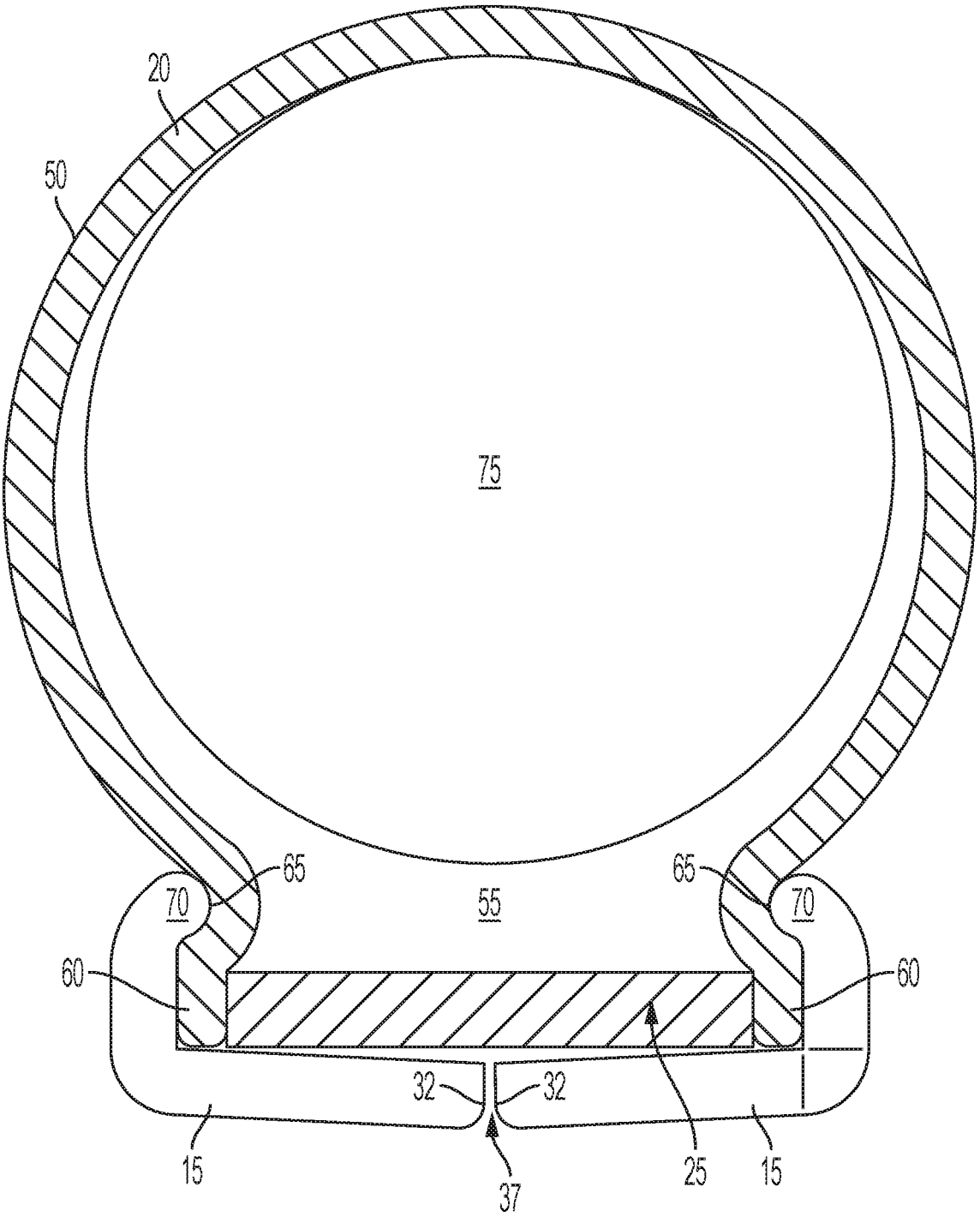
FIG. 3 is a sectional view of the embodiment of FIG. 1.
Figure 4:
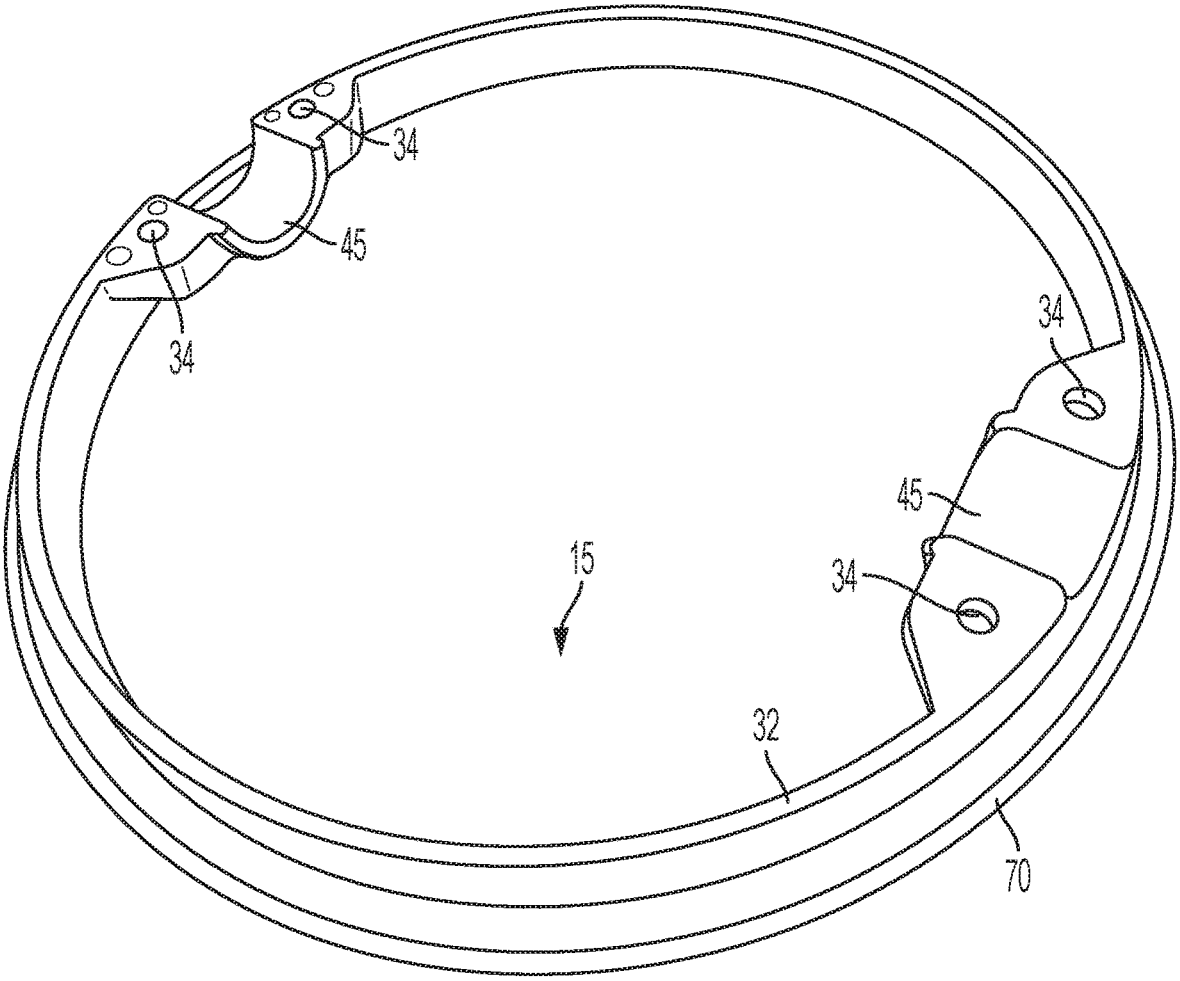
FIG. 4 is a perspective view of a rim component used in the embodiment of FIG. 1.

As shown in FIGS. 3-4, the hoop-shaped spacer member 25 is sized so that when the rims 15 are positioned about the hollow element 20, the rims 15 at their inner flange 32 do not contact each other. That is, each rim 15 terminates at an inner end 32, and by sizing the hoop-shaped spacer member 25 and the inner end 32 of each rim 15, a clamp load, or compressive load is generated by the fasteners 30 so that the hoop-shaped spacer member 25 and the hollow element 20 are fixed relative to each other. FIG. 1 shows a small gap, or space 37 that is formed between each inner end 32 of each rim 15 when the fasteners 30 are torqued so that the hoop-shaped spacer member 25 and the hollow element 20 are fixed relative to each other.

Figure 2:
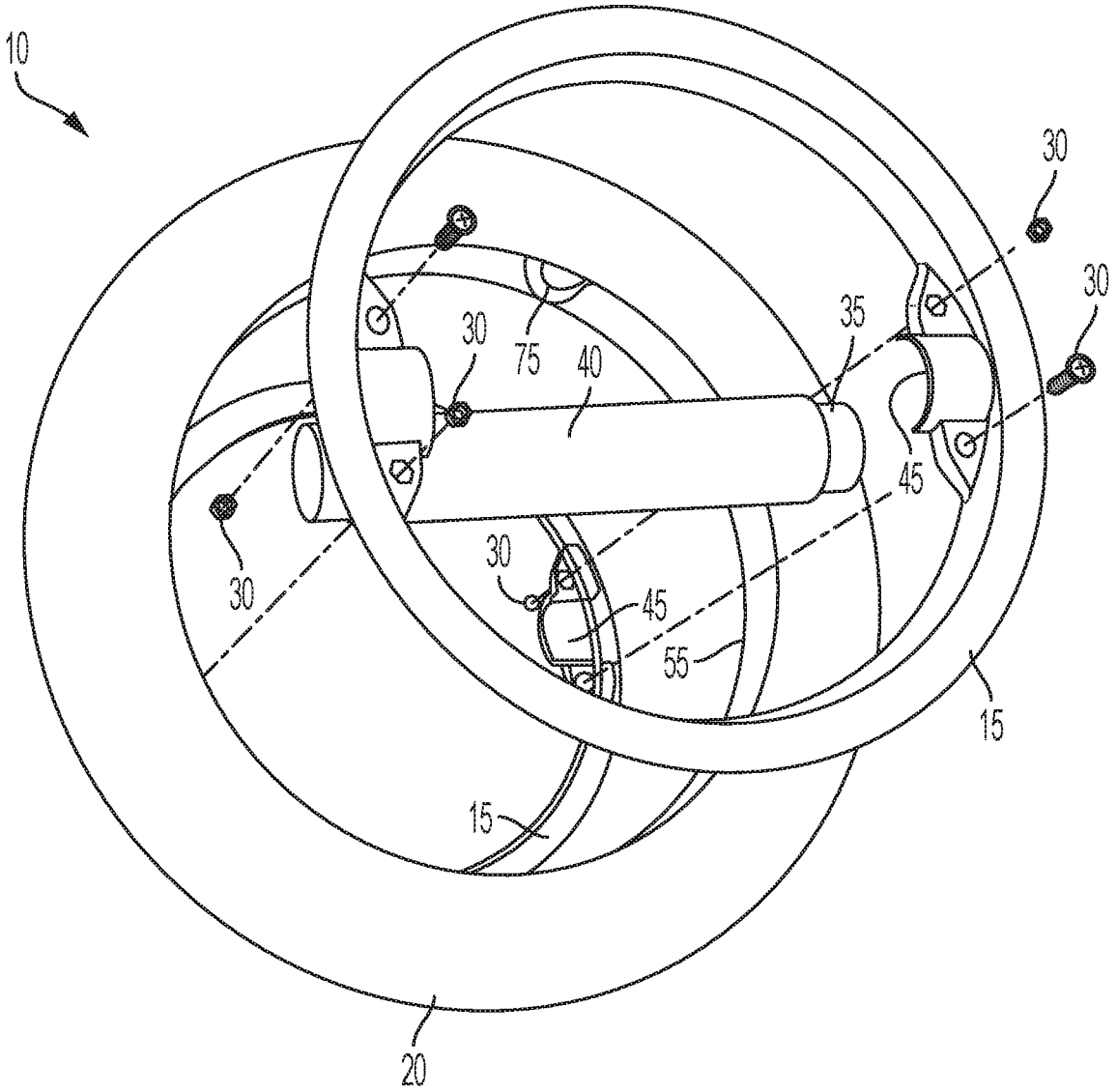
FIG. 2 is an exploded view of the embodiment of FIG. 1.

Also shown in FIGS. 1-3 is a handle 35 that includes a deformable grip element 40. Each rim 15 includes two half-circle shaped receivers 45 that capture each distal end of the handle 35 so that the handle 35 is fixed between the rims 15. In one embodiment, the handle 35 comprises a rigid cylindrical plastic, metal or carbon fiber material over which the deformable grip element 40 is placed.

Figure 5:
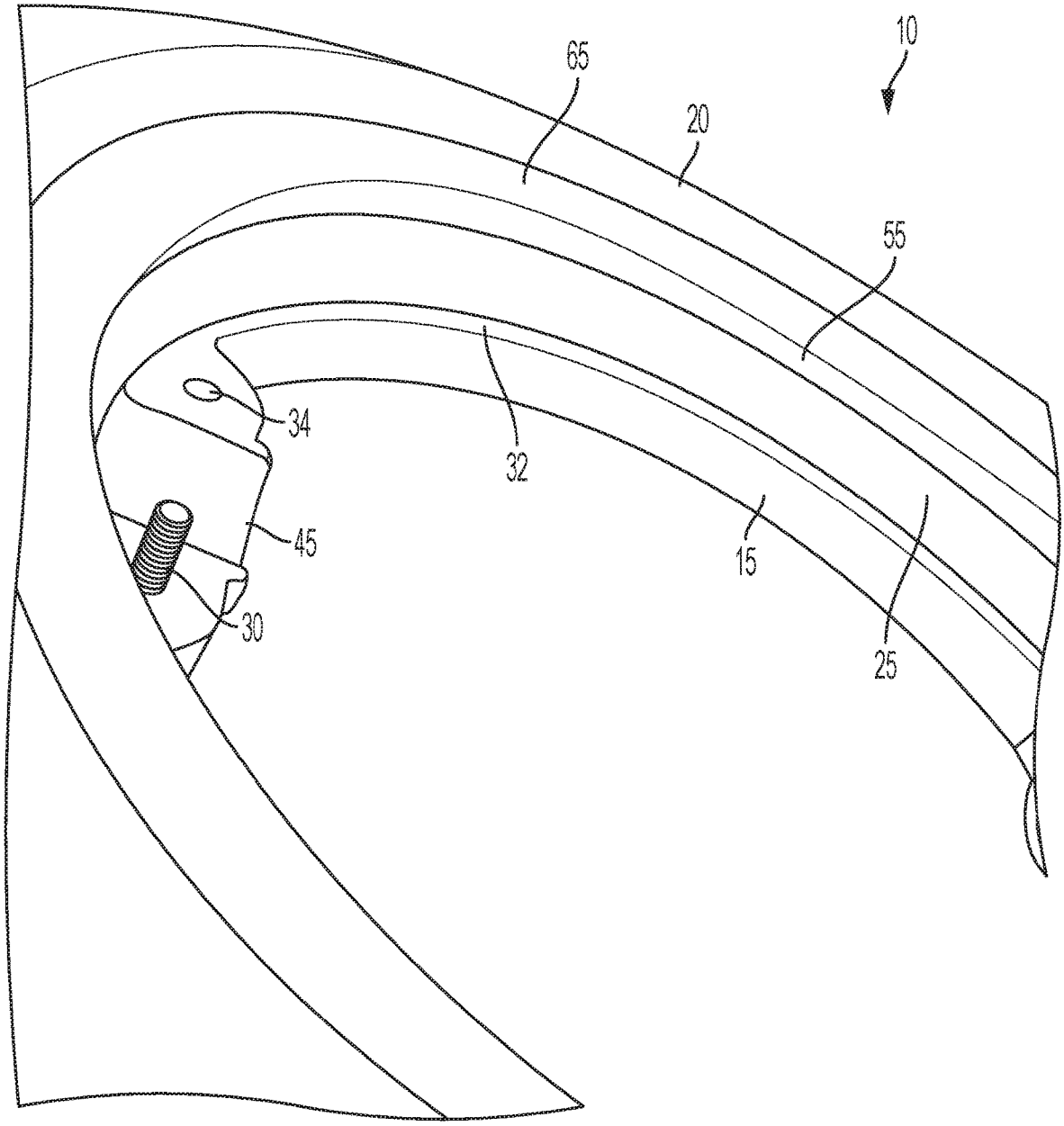
FIG. 5 is a perspective view of the embodiment of FIG. 1, with one rim removed.

As shown in the Figures, the hollow element 20 includes an exterior surface 50 and an interior cavity 55, and as shown in FIGS. 3 and 5, the hollow element 20 has a substantially U-shaped cross-section, the U-shape including two distal ends 60. Looking closely at FIGS. 3-5, each distal end 60 of the hollow element 20 has a rounded end section, with a depression 65 formed on one side of each distal end 60. Substantially matching the depression 65 is a lip 70 formed around the perimeter of each rim 15. The lip 70 of each rim 15 is sized to fit substantially within the depression 65 of each distal end 60 of the hollow element 20.

Fasteners 30, which in one embodiment may comprise a threaded bolt with a matching nut, or lock-nut, are placed in apertures 34 in each rim 15. The fasteners 30 are torqued, thereby locking the two rims 15 together. However, the rims 15 are sized so that the inner edge 32 of each rim 15 does not meet, or touch. That is, when the rims 15 are locked together by the fasteners 30, gap 37 is formed. But, as illustrated in FIG. 3, hoop-shaped member 25 is trapped between the rims 15, along with the distal ends 60 of the hollow element 20. In this way, the hollow element 20 is coupled or secured to the rims 15. Put differently, the rim 15 and hoop-shaped member 25 are sized in such a manner that when the distal ends of the hollow element 20 are compressed between rim 15 and hoop-shaped member 25 and the fasteners 30 are properly torqued, a gap 37 remains between the inner edge of rim 15 in order to maintain a compressive force on the distal ends of the hollow element 20.

Referring now to FIGS. 2-3, sphere, or ball 75 is located within the hollow element 20. The ball 75 may be comprised of several materials, including a rubber, a plastic, a polymer, an iron alloy, a stainless steel, an aluminum alloy, or a combination thereof. In one embodiment, the ball or sphere 75 may be magnetic. Additionally, the ball 75 can have different diameters or masses or surface textures in order to modify the rolling characteristics within the hollow element 20.

One feature of the invention is that the ball 75 rolls as it moves about the interior cavity 55. That is, the ball 75 does not slide, it rotates. In one embodiment, the surface of the interior cavity 55 may be rubber, that may have a coefficient of friction of about 1.0 In comparison, leather has a coefficient of friction of about 0.6, and ice has a coefficient of friction of about 0.09. Other embodiments may have the coefficient of friction of the interior cavity 55 greater than or less than 1.0. One aspect of the invention is that the combination of hollow element 20 materials and inner surface 55 physical characteristics may provide varying levels of rolling resistance to the circulating ball 75 depending on their velocity.

During use, a person, or user rotates the MED 10 in a circular motion causing the sphere, or ball 75 to travel around the round, hollow element or raceway 20. The hollow element 20 comprises an interior cavity 55 in which the sphere or spheres 75 travel. Each sphere 75 has a mass (i.e., a weight), and, in one embodiment, the MED 10 may include more than one sphere 75. In one embodiment, the spheres 75 may have different weights, different diameters and be made of different materials, or the spheres 75 may have the same weight and same diameters.

First, the ball 75 rotates by contact with the rubber interior cavity 55, with the ball 75 having its own rotational axis, and second, the MED 10 is rotated by a user who is holding the grip 40 and rotating the MED 10 about another axis. For example, when a user is holding the MED 10 at arms-length, and moving the MED 10 in a circular motion, which gets the ball 75 to rotate within the interior cavity 55.

Angular momentum is the rotational equivalent of linear momentum. Torque can be defined as the rate of change of angular momentum, analogous to force. So, as the ball 75 rolls about the interior cavity 55, angular momentum is generated, providing an additive force that a user feels when moving the MED 10. However, because there is friction, and thus frictional losses, between the ball 75 and the interior cavity 55, the angular momentum will decrease, without additional effort input by a user. Also, as a user changes their movement of the MED 10, an additional force or effort is required, as a torque must be applied to counteract the angular momentum generated by the movement of the ball 75 within the interior cavity 55. The user must apply a coordinated force to not only keep the ball 75 moving within the raceway 20, but also to control the entire MED 10. The level, or amount of force or effort required by a user increases with the addition of a second or third ball 75, or by moving the MED 10 more vigorously.

A novel feature of one embodiment of the MED 10 is the flexible rubber material used to construct the hollow element or raceway 20. In one embodiment, the flexible material may decelerate the ball or sphere 75 by deforming as the ball 75 rotates about the raceway 20. To counteract this, the user has to generate more force, or movement of the MED 10 to maintain the angular velocity of the sphere 75. Also, the deformable raceway 20 provides the user more tactile feedback, dampens the sound of the sphere or ball 75, and provides a friction surface that causes the sphere, or ball 75 to roll (not slide) around the hollow element, or raceway 20. The flexible material of the raceway 20 also decelerates the sphere 75 by slightly deforming, thereby requiring a user to generate greater force to maintain or increase angular velocity of the sphere or spheres 75.

As shown in the FIGS. 3 and 5, the MED 10 includes a hoop-shaped member or inner raceway 25. Ideally, when the MED 10 is in use, the sphere or spheres 75 only contact the hollow element interior cavity 55, and do not contact the hoop-shaped member or inner raceway 25. One feature of the MED 10 is that contact of one or more spheres 75 against the inner raceway 25 creates a sound because in one embodiment the inner raceway 25 is constructed of an iron alloy, or steel. In other embodiments, the inner raceway, or hoop-shaped member 25 may be constructed of aluminum or plastic. The sound and feel of a sphere 75 (which may also be constructed of steel) provides feedback to a user that they are not operating the MED 10 smoothly, efficiently or properly.

Different embodiments of the present invention may employ different materials for the hollow element, or raceway 20. One novel feature is that the raceway 20 may deform when one or more spheres or balls 75 are circulating within the raceway 20 in order to consume energy and to provide physical, tactile feedback to a person, or user (i.e., "feel"). An additional benefit of a deformable raceway 20 is to discourage a user from excessively flexing their fingers or "over gripping" the outside surface of the MED 10. That is, one feature of the present invention is that when a user squeezes the raceway 20 too hard it creates an undesirable flexion pattern and an increased sympathetic nervous system input as forceful gripping will deform the raceway 20, and partially, or fully obstruct the ball 75 from circulating around the raceway 20, which will prevent the MED 10 from functioning ideally. For example, excessively gripping or flexion patterning of the raceway 20 can increase undesirable sympathetic nervous system ("fight or fight") activity. Over-gripping is easily identified by a user as the spheres or ball 75 will be partially or fully obstructed as the deformable raceway 20 is compressed too much.

In one embodiment, the hollow element 20 should be flexible or deformable. However, the hoop-shaped member 25 should be substantially rigid. In a preferred embodiment, the hollow element 20 should be substantially seamless and continuous on an inside surface. The clearance between the hollow element interior cavity 55 and the sphere 75 is sized in such a way to aid in the rolling resistance of the sphere 75. For example, the inside clearance may range from 1 to 5 millimeters. That is, the contact between interior cavity 55 and sphere 75 is designed to achieve a rolling resistance.

One feature of the present invention is that the spheres, or balls 75 roll as they move within hollow element, or raceway 20. Generally, smooth surfaces do not provide sufficient resistance as the ball 75 tends to slide and glide instead of rolling. However, as discussed above, rolling requires greater effort from the user and provides greater tactile feedback to the user. On the other hand, extra rough surfaces may cause the circulating weight 75 to bounce. In a preferred embodiment, the interior surface of the raceway 20 has a rubber surface that is slightly roughened, either with a fabric liner, or the raceway 20 may be manufactured to include a slightly roughened interior surface. For example, the inner surface can be roughened by the addition of a fabric liner or cording applied to the interior surface of the raceway 20 or molded into the flexible raceway 20. Surface roughening can also be accomplished by physically texturing the surface.

In one embodiment, the hollow element, or raceway 20 is made of a solid material with no openings that allow a user to visually identify where the ball or balls 75 are within system. This further challenges the body's proprioceptive system. However, a clear or transparent raceway 20 may be used to make the MED 10 easier for a user to identify ball 75 location and control the MED 10.

It will be appreciated that the MED 10 can have single or multiple balls or spherical weights 75. The spherical weight(s) 75 can be metallic or any other material or combination of materials. For example, in one embodiment, metallic spherical weights 75 may be employed, and combined with a rubber raceway 20, the balls 75 may slightly "wear" or deform the interior cavity 55. In this embodiment, the MED 10 "improves with age" as movement of the ball 75 may become more consistent, which leads to better "feel" and responsiveness for the user. In addition, when multiple spherical weights 75 are employed, they can have different diameters and/or be constructed of different materials. Also, all or some of the spherical weight(s) 75 may be magnetic, which will also affect the movement of the weights, and the subsequent "feel" to the user.

Multiple different embodiments of the MED 10 are envisioned. For example, a MED 10 may have a round, hollow element 20 with different diameters, and balls 75 having different diameters and weights. The outer diameter of the hollow element 20 may reach 24 inches and the ball 75 diameter may reach 3" (with a weight of about 3.9 pounds). Larger diameter MED 10 may employ smaller diameter balls 75. For example, a 20-inch diameter hollow element 20 with four 1.5-inch diameter balls 75, having a total of 2 to 5 pounds of circulating weight may be constructed. Larger balls 75 may require increasing the hollow element 20 diameter to approximately 16-20 inches.

Figure 6:
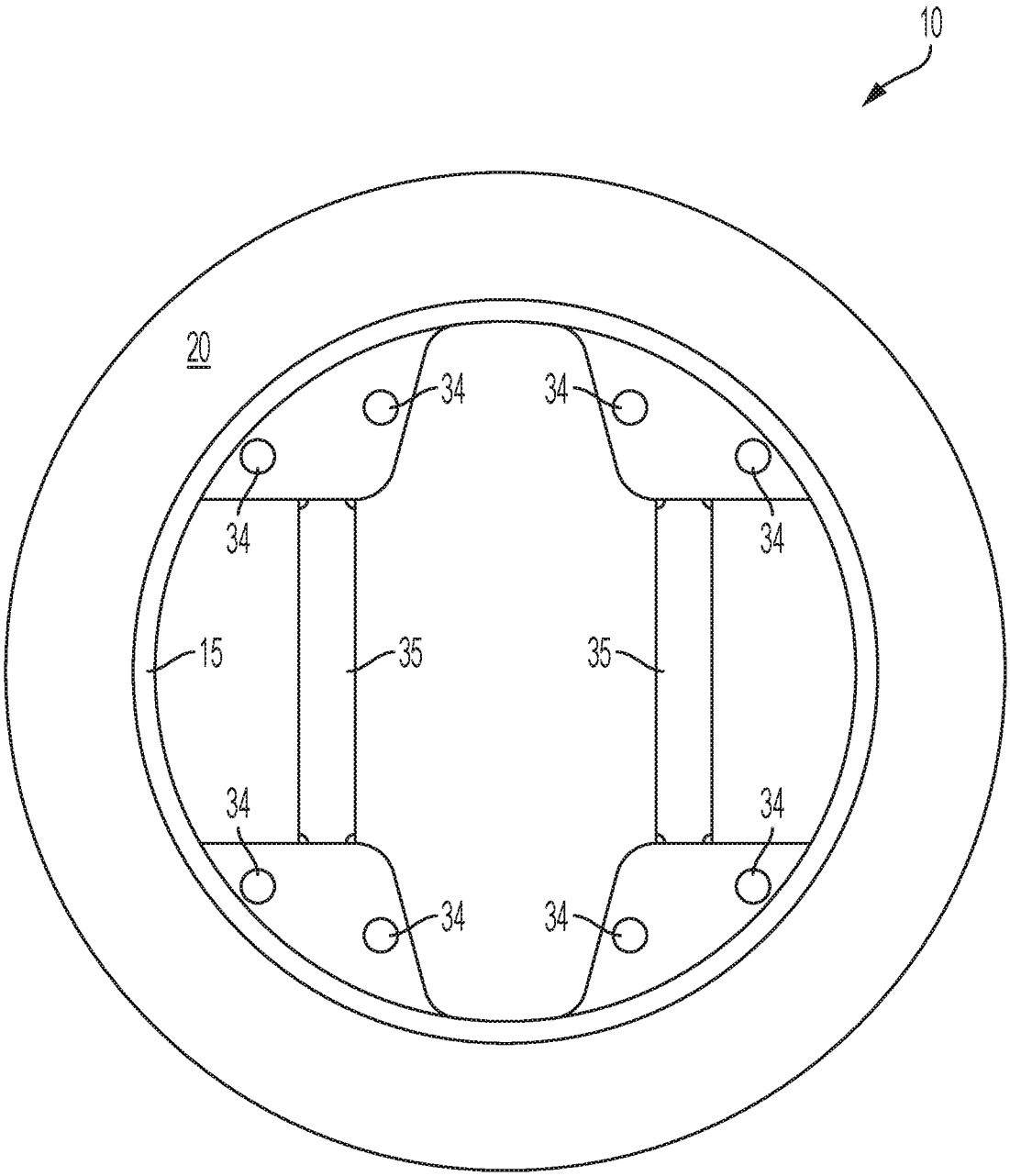
FIG. 6 is a plan view of a two-handle embodiment of the muscle exercising apparatus embodying the principals of the invention.

Referring now to FIG. 6, larger diameter MED 10 may have two or more handles 35 that are arranged parallel to each other. Or, a single handle 35 may pass through a center point, or be located tangential within the rims 15. The handles 35 may be rigid and fixated by tension members between the rims 15, or the handles 35 may be incorporated into the rim 15 of the MED 10. For example, a handle 35 may be formed as an integral extension of the rim 15 that connects inside of the rim 15 circumference or outside the hollow element or raceway 20. Or, the handle 35 may also be attached separately to the rims 15 on the inside of the rim 15 circumference or as an extension outside of the periphery of the raceway 20.

Alternatively, two handles 35 that run perpendicular to each other to form a "+" in the center of the rim 15 may be employed. This embodiment may employ one molded piece in the shape of a "+" or up to four separate straight pieces joined centrally by a mounting bracket. Other embodiments may have a smaller diameter so that a user may operate the MED 10 with a single hand. These embodiments may have a rim 15 diameter of about 5 to 6 inches with one or more smaller balls 75. Yet another embodiment of the present invention would have one or more handles 35 that are mounted perpendicular to the rim 15 and pass through the center of the "+." Yet another embodiment may have a single handle 35 with a central substantially round sphere shape integrated into the handle 35, so that a user can grip the sphere shape.

Figure 7:
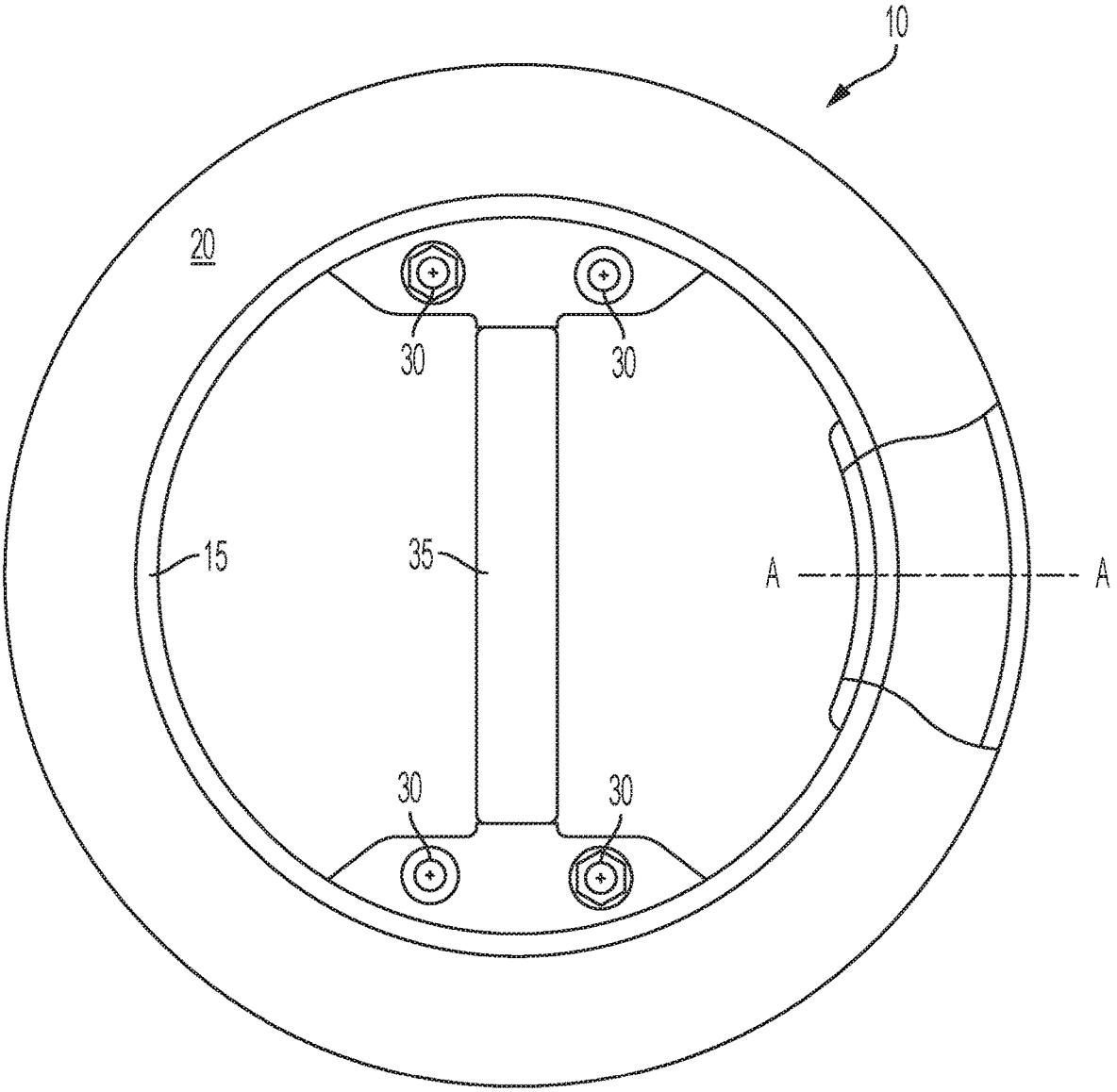
FIG. 7 is a plan view of an embodiment of the muscle exercising apparatus that includes an access panel.
Figure 8:
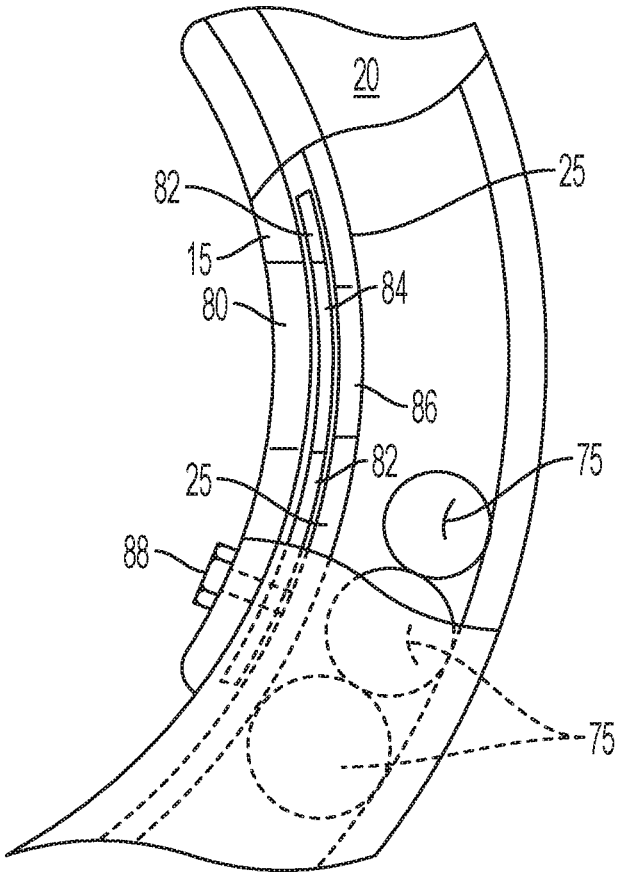
FIG. 8 is a close-up view of the embodiment of FIG. 7.
Figure 9:
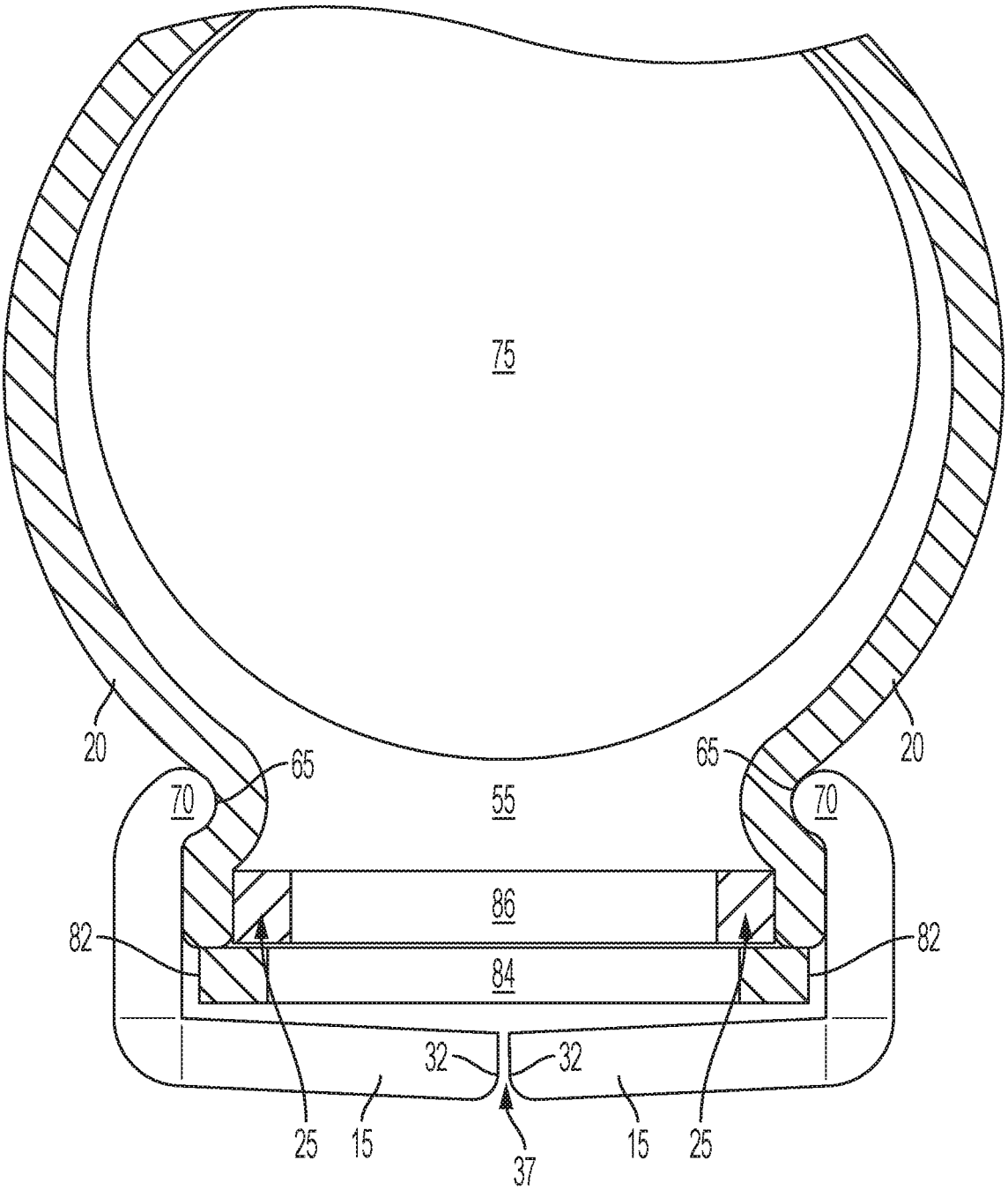
FIG. 9 is a sectional view taken along cutting plane A-A of the embodiment of FIG. 7.

Another embodiment of the MED 10 may include an access panel, or door system that allows the insertion and/or removal of balls 75 from the hollow element 20. Illustrated in FIGS. 7-9 is an embodiment of a MED 10 that includes this feature. In the illustrated embodiment, each rim 15 includes a rim aperture 80, with each rim aperture 80 comprising a half-circle, or semicircle shape. Adjacent to the rim 15 is a slide element 82 that includes a slide aperture 84. The slide element 82 may comprise a curved piece of aluminum that matches the curvature of the rim 15. As shown in FIGS. 7-9 the slide element 82 is sandwiched between the rim 15 and the hoop-shaped element 25 that includes an inner raceway aperture 86.

One rim 15 includes a slot (not shown) in which a tab (not shown) extending from the slide element 82 is located. To insert or remove a ball 75, the set screw 88, located in the rim 15 is loosened, or un-torqued, and the tab (not shown) is moved so that the slide aperture 84 aligns with the rim aperture 80 and the inner raceway aperture 86. One or more balls 75 may be inserted, or removed, then the tab (not shown) is again moved, so that the rim aperture 80 and the inner raceway aperture 86 are covered by a portion of the slide element 82 that does not include the slide aperture 84.

It will be appreciated that many different types of materials may used to construct the MED 10. For example, aluminum may be used to construct the rims 15, but this material may be replaced with carbon, plastic, steel, other metal alloys, or composite materials. Also, the rubber used to construct the hollow element 20 may be replaced with a plastic, polymer, silicone, silicone rubber, polyurethane, nylon or other material, including rubber containing cord or fabric incorporated within the rubber.

Thus, it is seen that a muscle exercising device is provided. One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations.

What is claimed is:

1. An exercise apparatus comprising:

a substantially round, hollow element comprising an exterior surface and an interior cavity, the substantially round, hollow element having a substantially U-shaped cross-section, the U-shape including two distal ends;

two rims, each rim positioned about a portion of the substantially round, hollow element at each distal end;

a spacer member located between each distal end of the U-shape and between the rims; and at least two fasteners positionable between both of the two rims, the fasteners structured to provide a clamping force to the two rims so that the spacer member and both distal ends of the substantially round, hollow element are fixed relative to each other.

2. The exercise apparatus of claim 1, further comprising at least one handle coupled to the two rims and spanning a diameter of both of the two rims so that the at least one handle is located within a diameter of the substantially round, hollow element.

3. The exercise apparatus of claim 1, further comprising at least one sphere located within the interior cavity of the substantially round, hollow element.

4. The exercise apparatus of claim 1, where the round, hollow element is comprised of a material that deforms when squeezed by a user.

5. The exercise apparatus of claim 1, wherein at least one sphere is located within an interior cavity of the substantially round, hollow element, the at least one sphere comprised of a material selected from a group consisting of: a rubber, a plastic, an iron, a steel, a stainless steel, an aluminum, and a combination of two or more thereof.

6. The exercise apparatus of claim 1, further comprising a plurality of spheres located within an interior cavity of the substantially round, hollow element, wherein the plurality of spheres each comprise a different weight or a different diameter.

7. The exercise apparatus of claim 1, further comprising:

a semicircular aperture located in each of the two rims, and arranged to form a first circular aperture;

a second circular aperture located in the spacer member, with the first and second apertures positionable over each other; and a third circular aperture located in a slideable element, the slideable element located between the spacer member and the two rims, with the slideable element moveable so that the third circular aperture is positionable relative to the first and second apertures.

8. The exercise apparatus of claim 1, wherein at least one sphere is located within an interior cavity of the substantially round, hollow element, and the exercise apparatus is capable of being rotated by a user in a generally circular motion causing the sphere to rotate relative to the substantially round, hollow element.

9. An exercise apparatus comprising:

a generally round, hollow element comprising an exterior surface and an interior cavity and formed into a circular shape;

a handle secured to the generally round, hollow element, with the handle spanning a diameter of the circular shape;

a sphere located within the interior cavity of the generally round, hollow element;

where the exercise apparatus is capable of being rotated by a user in a generally circular motion causing the sphere to rotate relative to the generally round, hollow element;

where the generally round, hollow element comprises an exterior surface and an interior cavity, the substantially round, hollow element having a substantially U-shaped cross-section, the U-shape including two distal ends;

further comprising two rims, each rim positioned about a portion of the generally round, hollow element at each distal end;

a spacer member located between each distal end of the U-shape and between the rims; and at least two fasteners positionable between both of the two rims, the fasteners structured to provide a clamping force to the two rims so that the spacer member and both distal ends of the substantially round, hollow element are fixed relative to each other.

10. The exercise apparatus of claim 9, where the round, hollow element is comprised of a material that deforms when squeezed by a user.

11. An exercise apparatus comprising:

a substantially round, hollow element comprising an exterior surface and an interior cavity, the substantially round, hollow element having a substantially U-shaped cross-section, the U-shape including two distal ends;

two rims, each rim positioned about a portion of the substantially round, hollow element at each distal end, a semicircular aperture located in each of the two rims, and arranged to form a first circular aperture;

a spacer member located between each distal end of the U-shape and between the rims, a second circular aperture located in the spacer member, with the first and second apertures positionable over each other; and a third circular aperture located in a slideable element, the slideable element located between the spacer member and the two rims, with the slideable element moveable so that the third circular aperture is positionable relative to the first and second apertures.

12. The exercise apparatus of claim 11, further comprising at least two fasteners positionable between both of the two rims, the fasteners structured to provide a clamping force to the two rims so that the spacer member and both distal ends of the substantially round, hollow element are fixed relative to each other.

13. The exercise apparatus of claim 11, further comprising at least one handle coupled to the two rims and spanning a diameter of both of the two rims so that the at least one handle is located within a diameter of the substantially round, hollow element.

14. The exercise apparatus of claim 11, further comprising at least one sphere located within the interior cavity of the substantially round, hollow element.

15. The exercise apparatus of claim 11, where the round, hollow element is comprised of a material that deforms when squeezed by a user.

16. The exercise apparatus of claim 11, wherein at least one sphere is located within an interior cavity of the substantially round, hollow element, the at least one sphere comprised of a material selected from a group consisting of: a rubber, a plastic, an iron, a steel, a stainless steel, an aluminum, and a combination of two or more thereof.

* * * * *